US012800272B2

(12) United States Patent
Baddeley et al.

(10) Patent No.: US 12,800,272 B2
(45) Date of Patent: Nov. 17, 2026

(54) METHODS AND SYSTEMS FOR LIVE FIRE ANALYSIS

(71) Applicant: Cervus Defence and Security Limited, Salisbury (GB)

(72) Inventors: Christopher Baddeley, Tiverton (GB); Bram Vandermeersch, Salisbury (GB); Edward Knight, Salisbury (GB); Phillip Craigie, Salisbury (GB)

(73) Assignee: Cervus Defence and Security Limited, Salisbury Wiltshire (GB)

( * ) Notice: Subject to any disclaimer, the term of this patent is extended or adjusted under 35 U.S.C. 154(b) by 218 days.

(21) Appl. No.: 18/690,505

(22) PCT Filed: Sep. 9, 2022

(86) PCT No.: PCT/EP2022/075150

§ 371 (c)(1),
(2) Date: Mar. 8, 2024

(87) PCT Pub. No.: WO2023/036954

PCT Pub. Date: Mar. 16, 2023

(65) Prior Publication Data

US 2024/0377167 A1 Nov. 14, 2024

(30) Foreign Application Priority Data

Sep. 10, 2021 (GB) ..... 2112909

(51) Int. Cl.
*F41J 5/14* (2006.01)
*F41G 3/26* (2006.01)

(52) U.S. Cl.
CPC . *F41J 5/14* (2013.01); *F41G 3/26* (2013.01)

(58) Field of Classification Search
CPC ..... F41J 5/14; F41G 3/26
See application file for complete search history.

(56) References Cited

U.S. PATENT DOCUMENTS 4,330,129 A * 5/1982 Meredith ..... F41J 1/10 273/372
4,807,888 A * 2/1989 Pidde ..... F41J 7/04 273/392

(Continued)

FOREIGN PATENT DOCUMENTS

| | | |
|---|---|---|
| WO | 2011037662 | 3/2011 |
| WO | 2017082877 | 5/2017 |
| WO | 2021048307 | 3/2021 |

OTHER PUBLICATIONS

International Search Report and Written Opinion in Application No. PCT/EP2022/075150 dated Sep. 9, 2022.

(Continued)

*Primary Examiner* — Malina D. Blaise
(74) *Attorney, Agent, or Firm* — Butzel Long

(57) ABSTRACT

There is provided systems and methods of projectile fire analysis of a live fire exercise. In one such method, where in the live fire exercise a plurality of participants fire projectiles at one or more targets using ranged weapons, the method comprises the following steps. Receiving from respective recording devices of each of the plurality of participants, respective timestamped projectile fire events detected at respective ranged weapons and each corresponding to the operator discharging a projectile from a ranged weapon and comprising a position of the ranged weapon. Receiving from respective recording devices connected to each of the one or more targets, timestamped projectile transit events detected at respective targets and each corresponding to the arrival of a projectile at the respective target. Identifying for each of at least some of the plurality of projectile transit events the respective projectile fire event corresponding to the firing of the projectile that arrived at the respective target, based at least in part on comparing the timestamps of the projectile transit events and the projectile fire events.

17 Claims, 12 Drawing Sheets

(56) References Cited

U.S. PATENT DOCUMENTS

| | | | | |
|---|---|---|---|---|
| 10,295,315 | B2 * | 5/2019 | Harris | F41J 1/10 |
| 12,345,511 | B1 * | 7/2025 | Kraft | F41J 5/14 |
| 2005/0153262 | A1 * | 7/2005 | Kendir | F41G 3/2655 434/21 |
| 2016/0209173 | A1 * | 7/2016 | Dribben | F41J 11/00 |
| 2017/0059288 | A1 * | 3/2017 | Campbell | F41J 7/04 |
| 2018/0202776 | A1 * | 7/2018 | Huang | F41J 5/00 |
| 2018/0239847 | A1 * | 8/2018 | Fertig | G06F 30/20 |
| 2019/0249963 | A1 * | 8/2019 | Pendleton | F41J 5/18 |
| 2021/0102782 | A1 * | 4/2021 | Tamir | F41G 3/2627 |
| 2022/0164643 | A1 * | 5/2022 | Charnock | G06N 5/046 |
| 2022/0398466 | A1 * | 12/2022 | Wu | G06N 3/0442 |
| 2023/0066716 | A1 * | 3/2023 | Zhang | G06V 10/16 |
| 2023/0235996 | A1 * | 7/2023 | Rempel | F41J 7/04 273/369 |
| 2024/0027173 | A1 * | 1/2024 | Leaning | F41J 7/06 |
| 2024/0320575 | A1 * | 9/2024 | Asadi | G06Q 10/06311 |

OTHER PUBLICATIONS

Search Report in Application No. GB2112909.3, dated Jun. 10, 2022.

* cited by examiner

| phase_id | device_id | time | lat | lon | shot_time_ms | angle | score | fault |
|---|---|---|---|---|---|---|---|---|
| 3s0vZGnrW5MS5b0l | 2375862484 | 2021-07-07T20:24:23.9540... | 50.8505933 | -0.9414 | 1625689463954 | 151.33181762695312 | 99.95165252685547 | GREAT SHOT |
| 3s0vZGnrW5MS5b0l | 2375862484 | 2021-07-07T20:24:46.5480... | 50.8505933 | -0.9414 | 1625689486548 | 43.57255554199219 | 99.80076599121094 | GREAT SHOT |
| 3s0vZGnrW5MS5b0l | 2375862484 | 2021-07-07T20:25:01.93400... | 50.8505933 | -0.9414 | 1625689501934 | 14.257035255432129 | 99.92317199707031 | GREAT SHOT |
| 3s0vZGnrW5MS5b0l | 2375862484 | 2021-07-07T20:26:56.277000... | 50.85062 | -0.941455 | 1625689616277 | 283.5872802734375 | 99.89137268066406 | GREAT SHOT |
| 4ERzTge0yOlRh2w3 | 2375862484 | 2021-07-07T18:19:47.996000 | 50.8506 | -0.9414567 | 1625681987996 | 292.49462890625 | 99.77985382080078 | GREAT SHOT |
| 4ERzTge0yOlRh2w3 | 2375862484 | 2021-07-07T18:19:48.351000 | 50.8506 | -0.9414567 | 1625681988351 | 350.28353881835594 | 99.86709594726562 | GREAT SHOT |
| 4ERzTge0yOlRh2w3 | 2375862484 | 2021-07-07T18:19:48.596000 | 50.8506 | -0.9414567 | 1625681988596 | 196.68391418457703 | 99.8634033203125 | GREAT SHOT |
| 4ERzTge0yOlRh2w3 | 2375862484 | 2021-07-07T18:19:49.332000 | 50.8506 | -0.9414567 | 1625681989332 | 29.7034969329834 | 99.963973999902344 | GREAT SHOT |
| 8aFigLME65rlCOST | 2606489032 | 2021-07-08T11:32:53.262000 | 51.2286267 | -2.155535 | 1625743973262 | 97.50433349609375 | 81.53480529785156 | POOR FOLLOW THROUGH |
| 8aFigLME65rlCOST | 2606489032 | 2021-07-08T11:39:33:940000 | 51.2286267 | -2.155535 | 1625744373940 | 60.73429489135742 | 93.87815856933594 | SUPPORT HAND PUSHING |
| 8aFigLME65rlCOST | 2606489032 | 2021-07-08T11:40:36:744000 | 51.2286267 | -2.155535 | 1625744373940 | 253.96031188964844 | 34.284690856933594 | SHOULDERING THE RIFLE |
| bc020gPuaTpM5i6c | 3070181298 | 2021-07-08T10:41:10.330000 | 51.2287483 | -2.1552933 | 1625740870330 | 347.9797668457031 | 58.307037353515625 | JERKING THE TRIGGER |
| bc020gPuaTpM5i6c | 3070181298 | 2021-07-08T10:41:12.497000 | 51.2287483 | -2.1552933 | 1625740872497 | 247.94822692871094 | 28.09949493408203 | SHOULDERING THE RIFLE |
| bc020gPuaTpM5i6c | 3070181298 | 2021-07-08T10:41:14.654000 | 51.2287483 | -2.1552933 | 1625740874654 | 38.597469329833984 | 84.58087921142578 | SUPPORT HAND PUSHING |
| bc020gPuaTpM5i6c | 3070181298 | 2021-07-08T10:42:52.3660... | 51.2287483 | -2.1552933 | 1625740972366 | 316.65692138671875 | 69.84903717041016 | PULLING WITH THE FIRING HAND |
| bc020gPuaTpM5i6c | 3070181298 | 2021-07-08T10:42:54.5060... | 51.2287483 | -2.1552933 | 1625740974506 | 168.11912536621094 | 69.92082214355469 | NOT ENOUGH TRIGGER FINGER |
| BCKAnsps1dJEy08d | 2375862484 | 2021-07-07T20:39:56.3040... | 50.8506383 | -0.9414617 | 1625690396304 | 64.78898620605469 | 99.83539581298828 | GREAT SHOT |
| BCKAnsps1dJEy08d | 2375862484 | 2021-07-07T20:40:02.6200... | 50.8506383 | -0.9414617 | 1625690402620 | 231.52784729003906 | 99.95634460449219 | GREAT SHOT |

Figure 6a

```
<Shots>
  <Shot ID="1" ExpNum="0">
    <Size>Small</Size>
    <Accur>Hit</Accur>
    <Time>1880</Time>
    <X>4</X>
    <Y>586</Y>
    <Azi>22</Azi>
    <TargetId>103</TargetId>
    <GroupId>0</GroupId>
    <Value>0</Value>
    <IsGraded>true</IsGraded>
    <Side>Foe</Side>
    <Offset>
      <Width>0</Width>
      <Height>0</Height>
    </Offset>
    <DT>2021-06-15T11:00:37.4488273+01:00</DT>
  </Shot>
  <Shot ID="2" ExpNum="0">
    <Size>Small</Size>
    <Accur>Hit</Accur>
    <Time>3536</Time>
    <X>-26</X>
    <Y>460</Y>
    <Azi>22</Azi>
    <TargetId>103</TargetId>
    <GroupId>0</GroupId>
    <Value>0</Value>
    <IsGraded>true</IsGraded>
    <Side>Foe</Side>
    <Offset>
      <Width>0</Width>
      <Height>0</Height>
    </Offset>
    <DT>2021-06-15T11:00:39.1048273+01:00</DT>
  </Shot>
  <Shot ID="3" ExpNum="0">
    <Size>Small</Size>
    <Accur>Hit</Accur>
    <Time>5260</Time>
```

Figure 6b

| SeqNo | Xcoord | Ycoord | Xerror | Yerror | Caliber | Elevation | Azimuth | Velocity | local_time | Target |
|---|---|---|---|---|---|---|---|---|---|---|
| 0 | -27 | 1380 | 10 | 20 | 58 | 0 | -163 | 818 | 07/05/2021 03:38:24.235 | lomah00 |
| 1 | -70 | 662 | 10 | 10 | 91 | 0 | -20 | 542 | 07/05/2021 03:38:34.812 | lomah00 |
| 2 | 294 | 1246 | 20 | 20 | 56 | 0 | -153 | 796 | 07/05/2021 03:38:36.425 | lomah00 |
| 3 | 257 | 1230 | 10 | 20 | 57 | 0 | -157 | 797 | 07/05/2021 03:38:37.263 | lomah00 |
| 4 | -111 | 1463 | 10 | 50 | 59 | 0 | -174 | 833 | 07/05/2021 03:38:38.416 | lomah00 |
| 5 | -1252 | 1314 | 10 | 50 | 65 | 0 | -226 | 1101 | 07/05/2021 03:39:03.432 | lomah00 |
| 6 | -43 | 1555 | 10 | 50 | 60 | 0 | -171 | 782 | 07/05/2021 03:39:04.735 | lomah00 |
| 7 | -53 | 1606 | 10 | 50 | 59 | 0 | -165 | 828 | 07/05/2021 03:39:05.864 | lomah00 |
| 8 | 741 | 1956 | 50 | 100 | 63 | 0 | -169 | 735 | 07/05/2021 03:39:10.150 | lomah00 |
| 9 | 404 | 1673 | 20 | 50 | 70 | 0 | -184 | 783 | 07/05/2021 03:39:11.014 | lomah00 |
| 10 | -232 | 1499 | 10 | 50 | 54 | 0 | -180 | 839 | 07/05/2021 03:39:12.470 | lomah00 |
| 11 | -384 | 910 | 10 | 10 | 60 | 0 | -108 | 893 | 07/05/2021 03:39:18.590 | lomah00 |
| 12 | 492 | 1526 | 20 | 50 | 59 | 0 | -165 | 777 | 07/05/2021 03:39:18.895 | lomah00 |
| 13 | -28 | 1268 | 10 | 20 | 56 | 0 | -107 | 847 | 07/05/2021 03:39:20.035 | lomah00 |
| 14 | 58 | 1478 | 10 | 50 | 57 | 0 | -160 | 812 | 07/05/2021 03:39:20.444 | lomah00 |
| 15 | -248 | 1083 | 10 | 10 | 65 | 0 | -112 | 824 | 07/05/2021 03:39:21.305 | lomah00 |
| 16 | -366 | 1335 | 10 | 20 | 68 | 0 | -166 | 820 | 07/05/2021 03:39:22.056 | lomah00 |
| 17 | -268 | 1201 | 10 | 20 | 57 | 0 | -113 | 884 | 07/05/2021 03:39:22.645 | lomah00 |
| 18 | -132 | 1337 | 10 | 20 | 58 | 0 | -166 | 841 | 07/05/2021 03:39:23.480 | lomah00 |
| 19 | -411 | 1170 | 10 | 20 | 62 | 0 | -117 | 915 | 07/05/2021 03:39:23.971 | lomah00 |
| 20 | -267 | 1170 | 10 | 20 | 57 | 0 | -109 | 891 | 07/05/2021 03:39:25.308 | lomah00 |
| 21 | 305 | 1834 | 20 | 50 | 57 | 0 | -106 | 794 | | lomah00 |
| 22 | -648 | 1361 | 10 | 20 | 64 | 0 | -69 | 924 | 07/05/2021 04:46:35.457 | lomah00 |
| 23 | -66 | 1792 | 10 | 50 | 58 | 0 | -103 | 831 | 07/05/2021 04:46:36.335 | lomah00 |
| 24 | -473 | 776 | 10 | 10 | 58 | 0 | -29 | 796 | 07/05/2021 04:46:37.166 | lomah00 |
| 25 | -653 | 1589 | 10 | 50 | 61 | 0 | -111 | 821 | 07/05/2021 04:46:37.445 | lomah00 |
| 26 | -254 | 705 | 10 | 10 | 58 | 0 | -40 | 884 | 07/05/2021 04:46:38.475 | lomah00 |
| 27 | 2 | 945 | 10 | 10 | 55 | 0 | -39 | 806 | 07/05/2021 04:46:39.822 | lomah00 |
| 28 | -353 | 1335 | 10 | 20 | 55 | 0 | -103 | 864 | 07/05/2021 04:46:41.049 | lomah00 |
| 29 | -336 | 1306 | 10 | 20 | 50 | 0 | -102 | 852 | 07/05/2021 04:46:42.617 | lomah00 |

Figure 6c

METHODS AND SYSTEMS FOR LIVE FIRE ANALYSIS

FIELD OF THE INVENTION

The present invention relates to marksmanship analysis in live fire exercise, in particular identifying firing events corresponding to target hits.

BACKGROUND OF THE INVENTION

In order to measure and improve the overall effectiveness of armed forces such as military or civil defence services their personnel are subject to many training and evaluation exercises throughout their service. These exercises usually focus on specific aspects of the personnel's service capabilities.

One such important focus is marksmanship, or the use and handling of ranged weapons. Armed forces personnel are equipped with ranged weapons, typically firearms, either for their personal protection, or to complete their role within the wider organisation. To complement this these personnel are subject to many different, ongoing, marksmanship or ranged weapons training exercises to assess and maintain their effectiveness in the use of these weapons. These exercises range from safe handling and operation of weapons including how to strip and assemble the weapon for maintenance, simulated firing exercises where instrumented gas operated weapons that when fired at a projector screen emit a laser that provides marksmanship feedback are used (such as the dismounted close combat trainer (DCCT)), all the way through to live fire exercises where personnel fire live ammunition at inanimate static and mobile targets.

Live fire exercises in particular can be useful as they provide a more realistic experience to the participating personnel (subjecting them to effects such as the weapons recoil etc.) and thus provide for more effective training and more accurate assessment of marksmanship. Live fire exercises can take the form of lined static ranges, such as live fire marksmanship training (LFMT), where there are targets in each lane at various distances and different sizes. In LFMT there is only one participant (or firer) per lane and therefore per target. The participant's performance can then be directly assessed by examining the target to determine accuracy, spread and other useful measures of marksmanship. In some case the targets are instrumented with appropriate sensors which allow the automatic determination of these measures by detecting projectile hits at the target (and often projectile misses such as when the projectile passes immediately around the target in the so-called "near miss" area). A more advance version of such live fire exercises is termed, transition to live fire tactical training (TLFTT), and involves more complex moving target patterns along with required movement of the participant (so-called Fire and Movement tests). These exercises are again conducted on purpose-built ranges with firers occupying specified lanes allowing participant performance to be evaluated by examining the relevant targets. In some cases two participants may be given the same lane resulting in only aggregate performance being available.

The pinnacle of marksmanship training is often regarding as live fire tactical training (LFTT) which involves personnel operating in progressively larger tactical formations within a piece of chosen terrain and a tactical scenario. During LFTT all personnel can fire at all targets from a multitude of locations (within the safety constraints of the firing range). Such training is typically performed at least annually in most military services for most personnel. It can provide some of the most accurate assessment of operational effectiveness of the overall group of personnel, short of monitoring actual deployments, and provides a realistic training environment. Unfortunately, whilst the marksmanship performance of the group of participants as a whole can be monitored and recorded during such an exercise, individual contributions to that performance are difficult and in some cases impossible, to consistently record. In particular, assessment of the targets can indicate how many hits were on target during such an exercise, but the individual marksmanship—e.g. which personnel were consistently on target, which were off target etc.—is not recorded due to the extreme difficulties in identifying which particular shot fired actually hit the target.

Whilst tactical training may also be done with simulated fire systems such as in a Tactical Engagement Simulation (TES) this is clearly not as realistic or effective as live fire exercises. In the simulated fire tactical exercises such as TES laser systems with blank firing weapons are used instead of live firing weapons. The laser systems have participant identifiers can be coded into the laser produced by their own weapon and thus when a "hit" is detected the firer can be identified—an example of such a system is the multiple integrated laser engagement system, commonly known as MILES. Such a system is not practical however in live fire exercises where real-world standardised projectiles are fired.

As such this presents a lacuna between the more granular marksmanship information that can be extracted from costly instrumented simulated tactical exercises, compared with the more realistic preferable live fire tactical exercises.

SUMMARY OF THE INVENTION

It is an object of the present invention to provide methods and systems for attributing hits on targets to individual firers where there are multiple firers firing projectiles at multiple targets.

The invention provides methods of capturing a marksmanship data during a live fire exercise (such as tactical exercises using live ammunition) wherein a plurality of participants (such as combat personnel) fire solid projectiles at one or more targets using ranged weapons. The method may comprise recording a plurality of timestamped projectile fire events detected at respective ranged weapons and each corresponding to the respective ranged weapon discharging a projectile, each timestamped projectile fire event recorded at a recording device of the operator of (in other words the participant operating) the respective ranged weapon; recording a plurality of timestamped projectile transit (or arrival) events detected at respective targets and each corresponding to the arrival (or transit across) of a projectile at the respective target, each timestamped projectile transit event recorded at a recording device of the respective target; identifying for each of at least some of the plurality of projectile transit events the respective projectile fire event corresponding to the firing of the projectile that arrived at the respective target, by comparing the projectile transit events and the projectile fire events (or more particularly based at least in part on comparing the timestamps of the projectile transit events and the projectile fire events). It will be appreciated that the recording device may timestamp each event (fire and/or transit events) as it is detected. The transit events may be hit events, indicating a target has been hit by the projectile and/or miss events indicating that a projectile has missed (but is in proximity to) the target.

Typically, said identifying comprises optimizing a bipartite graph representing the plurality of hit events and the plurality of transit events, said bipartite graph comprising one or more edges linking a respective projectile fire event to a respective transit event. Each edge may be weighted according to one or more measures of discrepancy between the respective hit event and the respective transit event. In particular each edge may be weighted according to a difference between the timestamp of the respective hit event and the timestamp of the respective transit event. For example, each edge may weighted according to a difference between a projected (or predicted) target transit time corresponding to the respective projectile fire event and the respective projectile transit event and the timestamp of the respective transit event. In this way the optimizing may be considered to be minimizing the overall discrepancy subject to a maximum number of matches being present. It will be appreciated that other identifying schemes (or algorithms) may be used, such as attributing probabilities to each potential set of matches and selecting the set of matches with the maximal probability. Further measures of discrepancy may include any one or more of: a difference between the calibre in the projectile fire event and the calibre in the projectile transit event; a difference (or discrepancy) between the aspect (or angle on incidence) of the projectile transit event and the weapon direction in the projectile fire event; a difference between a recorded arrival velocity at the target recorded in the projectile transit event and a predicted velocity.

The step of identifying may be performed separately from the other steps of the above method (for example after an exercise is finished) and form part of a further method of projectile fire analysis of a live fire exercise, the method further comprising: receiving from respective recording devices of each of the plurality of participants, respective timestamped projectile fire events detected at respective ranged weapons and each corresponding to the operator discharging a projectile from a ranged weapon; and receiving from respective recording devices connected to each of the one or more targets, timestamped projectile transit events detected at respective targets and each corresponding to the (transit arrival of a projectile at the respective target.

In some embodiments the respective timestamp of each projectile fire event and each projectile transit event is generated based on an internal clock of the respective recording device. Here, the method may also comprise synchronising the plurality of timestamped fire events and the plurality of timestamped transit events to a common time line (or time series).

The synchronising may comprise applying a respective time offset to one or more events based on a time offset between the internal clock of the respective recording device and a common time source. Such a time offset may be calculated by comparing timestamps of one or more synchronization messages received from each recording device to a common (or central) time source. Additionally, or alternatively, said synchronising may comprise synchronising the internal clocks of one or more recording devices to a common time source prior to the live fire exercise.

In some embodiments each of plurality of timestamped fire events is associated with geographical coordinates of the respective ranged weapon representing the position of the ranged weapon (or operator thereof) when discharging the projectile. Here the projected target transit time may be based on the distance between the geographical coordinates of the respective ranged weapon and the geographical coordinates of the target, and the timestamp of the respective projectile fire event.

In some embodiments the respective timestamp of each projectile fire event and each projectile transit event is generated based on an external clock (such as a GPS time signal).

In some embodiments the projectile fire events are detected by a weapon sensor arrangement mounted to the respective ranged weapon. Such weapon sensor arrangement may comprise any one or more of: gyroscopic sensors; acoustic sensors; accelerometers; magnetometers; flash sensors; and tilt switches. For example the weapon sensor arrangement may be a Mantis device.

Preferably the recording devices for the projectile fire events are smartphones. It will be appreciated that this has the advantage of utilizing equipment already present in the live fire exercise and ensuring minimal changes to the various protocols thereof.

In some embodiments the one or more projectile arrival events are detected by a target sensor arrangement mounted to the respective target (such as a LOMAH device). Such a target sensor arrangement may comprise any of: gyroscopic sensors; acoustic sensors; accelerometers; magnetometers; and tilt switches.

In some embodiments detecting the projectile transit events comprises detecting a calibre of the respective projectile, and the detected calibre is recorded with the projectile transit event.

In some embodiments detecting the projectile transit events comprises detecting an angle of incidence of the respective projectile with the target, and the detected angle of incidence is recorded with the projectile transit event.

In some embodiments detecting the one or more projectile arrival events comprises detecting whether the respective projectile hit or missed the respective target, and the detected hit or miss is recorded with the projectile arrival event.

The methods may further comprises steps of analysing the matched projectile transit and projectile fire events. For example the methods may further comprise attributing one or more projectile transit events to the participant corresponding to the matching projectile fire events. The projectile transit events for said participant may then be output or displayed (such as to the participant via the participants recording device or smartphone). Equally, one or more marksmanship metrics for the participant may be generated (and optionally output) based on the projectile transit events attributed to said participant.

The invention also provides apparatus corresponding to, and comprising elements, modules or components arranged to put into effect the above methods, for example one or more various suitably configured computing devices.

In particular, the invention therefore provides an analysis system for a live fire exercise. The system comprises, a receiving module, arranged to receive from respective recording devices of each of the plurality of participants, respective timestamped projectile fire events detected at respective ranged weapons and each corresponding to the operator discharging a projectile from a ranged weapon; and receive from respective recording devices connected to each of the one or more targets, timestamped projectile transit events detected at respective targets and each corresponding to the (transit arrival of a projectile at the respective target. A matching module arranged to identify for each of at least some of the plurality of projectile transit events the respective projectile fire event corresponding to the firing of the projectile that arrived at the respective target, by comparing the projectile transit events and the projectile fire events (or more particularly based at least in part on comparing the timestamps of the projectile transit events and the projectile fire events).

The invention also provides one or more computer programs suitable for execution by one or more processors, such computer program(s) being arranged to put into effect the methods outlined above and described herein. The invention also provides one or more computer readable media, and/or data signals carried thereon storing such computer programs.

BRIEF DESCRIPTION OF THE DRAWINGS

Embodiments of the invention will now be described, by way of example only, with reference to the accompanying drawings, in which:

FIG. 6*a* shows example projectile fire events such as those that may be generated by the methods and systems of the invention;

FIGS. 6*b* and 6*c* show example projectile transit events such as those that may be generated by the methods and systems of the invention;

DETAILED DESCRIPTION OF EMBODIMENTS OF THE INVENTION

In the description that follows and in the figures, certain embodiments of the invention are described. However, it will be appreciated that the invention is not limited to the embodiments that are described and that some embodiments may not include all of the features that are described below. It will be evident, however, that various modifications and changes may be made herein without departing from the broader spirit and scope of the invention as set forth in the appended claims.

Figure 1A:
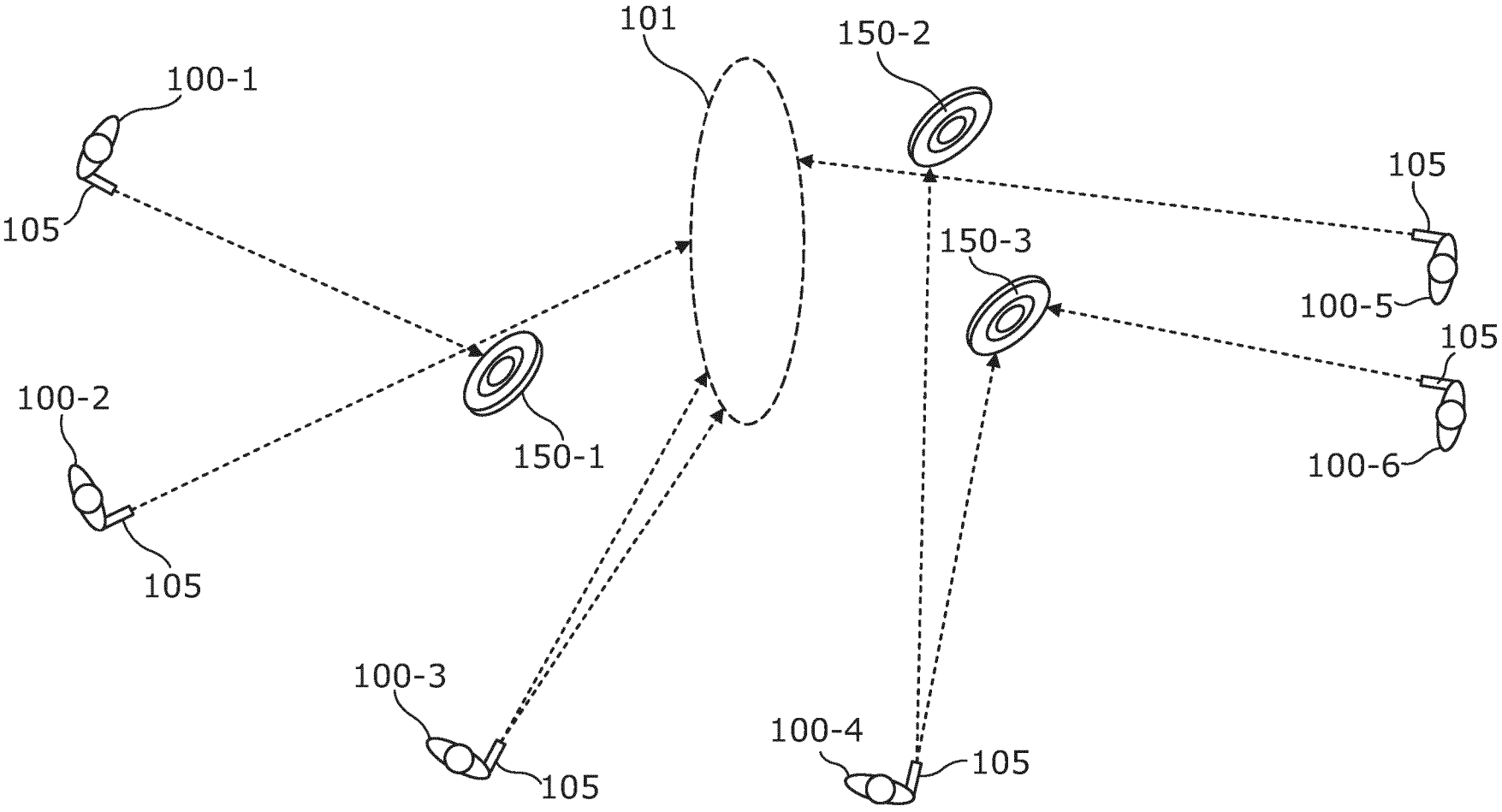
FIG. 1*a* illustrates a situation in which a plurality of participants are firing projectiles at a plurality of inanimate targets as part of a live fire exercise.

FIG. 1*a* illustrates a situation in which a plurality 100 of participants (or troops or combatants or firers) 100-1; 100-2; 100-3; 100-4; 100-5; 100-6 are firing projectiles at a plurality of inanimate targets 150-1; 150-2; 150-3 as part of a live fire exercise. The situation typically corresponds to a live fire exercise (such as a live fire tactical training exercise as set out previously). For ease of understanding the reference numeral 100-*n* will be used herein below to refer to a general participant, and similarly the reference numeral 150-*n* will be used to refer to a general target.

Each participant 100-*n* is equipped with a ranged weapon 105 (such as a firearm) which can be operated by the participant to fire (or launch or otherwise discharge) a projectile (such as a round of ammunition or a bullet or the like). In this way the participants may be considered to be operators of their respective ranged weapons. The participants 100-*n* are typically able to move relative to the targets 150-*n* and to each other. The participants 100-*n* during the course of the live fire exercise fire projectiles at one or more of the targets 150-*n*. The projectiles fired at the targets 150-*n* may hit or miss the targets 150-*n* based on the ability of the respective participant and/or other factors such as cross wind, range between the participant and the target, accuracy of the weapon and so on.

Each target has (or is equipped with) a target sensor arrangement arranged to detect a projectile hit on (or arrival at) the target 150-*n* as will be described shortly below.

There is also shown in FIG. 1*a* a terrain feature 101 (such as a hill, building or the like) which limits the line of fire from different positions across the terrain.

As the situation continues (such as during the course of a live fire exercise) the participants 100-*n* fire (or discharge) their ranged weapons 105. Participants may discharge their ranged weapons with the aim of hitting one of the targets 150-*n*. However, participants may also discharge fire their ranged weapon 105 for other reasons such as to simulate covering fire. FIG. 1*a* shows each of the participants firing a solid projectile from their respective ranged weapon 105. The path taken by the projectile is shown by the dotted arrow. It will be appreciated that FIG. 1*a* is merely illustrative and in not intended to show all of the ranged weapons 105 being fired simultaneously, however some may be. The discharge (or firing) of a ranged weapon to launch a solid projectile may be termed a firing event, and will be referred to as such herein.

As can be seen in FIG. 1*a* for some firing events the resulting projectile hits one of the targets 150-*n*. This may be termed a hit event, and will be referred to as such herein.

In the particular example scenario in FIG. 1*a* there are eight firing events and four hit events—i.e. eight projectiles were fired from ranged weapons 105 and the three targets 150-*n* were hit a total of four times. The first participant 100-1 fired a solid projectile that hit the first target 150-1. The second participant 100-2 fired a solid projectile that missed the first target 150-1. The third participant 100-3 fired two projectiles that were both stopped by the terrain feature 101. The fourth and sixth participants 100-4; 100-6 both fired solid projectiles that hit the third target 150-3. The fourth participant 100-4 fired a second projectile that hit the second target 150-2. The fifth participant fired a solid projectile that missed the second target 150-2.

In a subsequent analysis of the scenario it would typically be possible to determine how many projectiles were fired, for example based on the difference in number of projectiles carried by the participants at the start of the scenario and carried by the participants at the end of the scenario. It would typically also be possible to determine the number of hit events. This can be done by direct inspection of the targets 150-*n* which may show damage (such as bullet holes) for each hit event, or based on hit events detected by the sensor arrangements at each target 150-*n*. It will be appreciated that such data only provides an aggregate picture of the performance of all of the participants. For example, such data does not distinguish the fourth participant 100-4 who hit a target with both shots fired from the third participant 100-3 who did not hit a target at all.

However, in line with the present invention each participant **100-*n* has a recording device arranged to record a timestamped projectile fire event each time a projectile is fired from the participant's 100-*n* ranged weapon 105. The timestamped projectile fire event indicates that a projectile has been fired by the ranged weapon with a timestamp indicating the time at which the projectile was fired. The timestamped projectile fire events are also marked with the positons of the participant 100-*n* at the point the projectile was fired. The fire events are marked with the participant 100-*n* (or ranged weapon 105-*n*) responsible for the firing. It will be appreciated that marking the fire events with the identity of the ranged weapon 105-*n* is preferable in scenarios where a participant 100-*n*** is equipped (or has) more than one weapon.

Similarly, each target **150-*n* is connected to a recording device arranged to record a timestamped projectile hit event each time a projectile hits said target 150-*n*. The timestamped projectile hit event indicates that a projectile has hit the target with a timestamp indicating the time at which the target was hit. The projectile hit events are marked with the target 150-*n*** hit.

FIG. **1*b* schematically illustrates an analysis system 130 that may be used in scenarios such as that depicted in FIG. 1*a***

The analysis system 130 is arranged to receive the timestamped projectile fire events 170 recorded at the recording devices of the operators (such as the participants **100-*n*) of the respective ranged weapons 105. This may typically be achieved by direct or wireless connection to the recording devices of the operators after the live fire event. The analysis system is also arranged to receive the timestamped projectile hit events 180 recorded at the recording devices connected to the respective targets 150-*n*. This may typically be achieved by direct or wireless connection to the recording devices of the target 150-*n* during the live fire event. However it will be appreciated that the timestamped projectile hit events 180 may be received in the same manner as the timestamped projectile fire events 170** and vice versa.

The analysis system 130 is arranged to identifying for each of at least some of the projectile hit events the respective projectile fire event corresponding to the firing of the projectile that arrived at the respective target, by comparing the projectile transit events and the projectile fire events. In particular, by comparing timestamps of the projectile transit events and the projectile fire events, and the relative positions of the projectile fire events with the respective targets of the projectile transit events. In this way it will be appreciated that the analysis system 130 may output one or more matches 190 between projectile fire events and projectile hit events.

In particular, the analysis system may match a projectile hit event with a projectile fire event based on a predicted (or projected) hit time. The predicted hit time for a particular projectile hit event and projectile fire event pair may be determined based on a known projectile velocity for the ranged weapon corresponding to the projectile fire event and the distance between the position recorded in the projectile fire event and the position of the target. The analysis system 130 may be arranged to only match a projectile hit event with a particular projectile fire event if the predicted hit time is within a pre-defined threshold of the projectile hit event timestamp. Where more than one projectile fire event satisfies the criteria the analysis system 130 may be arranged to select one of the projectile fire events based on further criteria, such as the projectile fire event with the predicted hit time that is closest to the projectile hit event timestamp.

The analysis system 130 may be arranged to apply a bipartite matching algorithm to the events where an edge weight between a projectile hit event and a projectile fire event is a function of the timestamp of the projectile hit event and the timestamp of the projectile fire event. In this way the analysis system 130 may be arranged to optimise the edges with the aim of fining an extremum total edge weight. The resulting optimized edges between projectile fire events and projectile hit events corresponding to identified matches 190.

The matches may be used to attributed (or otherwise allocate) projectile hit events (target hits) to the operator that fired the shot (the operator of the projectile fire event). In this way target hits may be analysed and/or displayed on a per participant basis.

As such, the resulting identified matches 190 may be used or processed to provide measures of performance for the participants of the live fire exercise. For example individual participants can be provided with a measure of their shots on target by comparing the number of shots they fired with the number of their projectile fire events that were matched with a projectile hit event. Participants may be ranked based on this measure.

Figure 2:
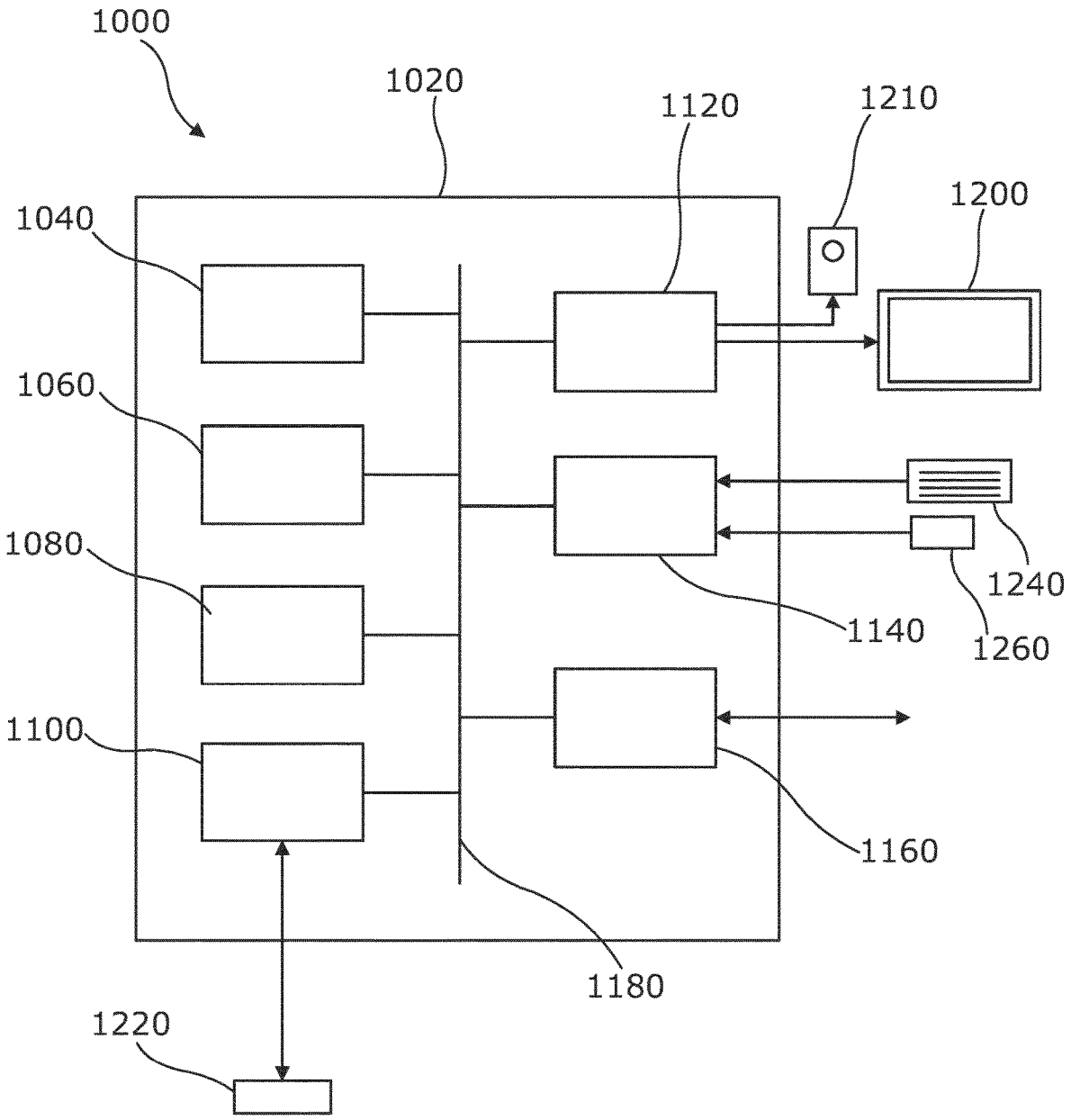
FIG. 2 schematically illustrates an example of a computer system which may be used to implement systems of the invention.

FIG. 2 schematically illustrates an example of a computer system 1000 which may be used to implement systems of the invention, such as the analysis system 130 and or the recording devices. The system 1000 comprises a computer 1020. The computer 1020 comprises: a storage medium 1040, a memory 1060, a processor 1080, an interface 1100, a user output interface 1120, a user input interface 1140 and a network interface 1160, which are all linked together over one or more communication buses 1180.

The storage medium 1040 may be any form of non-volatile data storage device such as one or more of a hard disk drive, a magnetic disc, an optical disc, a ROM, etc. The storage medium 1040 may store an operating system for the processor 1080 to execute in order for the computer 1020 to function. The storage medium 1040 may also store one or more computer programs (or software or instructions or code).

The memory 1060 may be any random access memory (storage unit or volatile storage medium) suitable for storing data and/or computer programs (or software or instructions or code).

The processor 1080 may be any data processing unit suitable for executing one or more computer programs (such as those stored on the storage medium 1040 and/or in the memory 1060), some of which may be computer programs according to embodiments of the invention or computer programs that, when executed by the processor 1080, cause the processor 1080 to carry out a method according to an embodiment of the invention and configure the system 1000 to be a system according to an embodiment of the invention. The processor 1080 may comprise a single data processing unit or multiple data processing units operating in parallel or in cooperation with each other. The processor 1080, in carrying out data processing operations for embodiments of the invention, may store data to and/or read data from the storage medium 1040 and/or the memory 1060.

The interface 1100 may be any unit for providing an interface to a device 1220 external to, or removable from, the computer 1020. The device 1220 may be a data storage device, for example, one or more of an optical disc, a magnetic disc, a solid-state-storage device, etc. The device 1220 may have processing capabilities—for example, the device may be a smart card. The interface 1100 may therefore access data from, or provide data to, or interface with, the device 1220 in accordance with one or more commands that it receives from the processor 1080.

The user input interface 1140 is arranged to receive input from a user, or operator, of the system 1000. The user may provide this input via one or more input devices of the system 1000, such as a mouse (or other pointing device) 1260 and/or a keyboard 1240, that are connected to, or in communication with, the user input interface 1140. However, it will be appreciated that the user may provide input to the computer 1020 via one or more additional or alternative input devices (such as a touch screen). The computer 1020 may store the input received from the input devices via the user input interface 1140 in the memory 1060 for the processor 1080 to subsequently access and process, or may pass it straight to the processor 1080, so that the processor 1080 can respond to the user input accordingly.

The user output interface 1120 is arranged to provide a graphical/visual and/or audio output to a user, or operator, of the system 1000. As such, the processor 1080 may be arranged to instruct the user output interface 1120 to form an image/video signal representing a desired graphical output, and to provide this signal to a monitor (or screen or display unit) 1200 of the system 1000 that is connected to the user output interface 1120. Additionally or alternatively, the processor 1080 may be arranged to instruct the user output interface 1120 to form an audio signal representing a desired audio output, and to provide this signal to one or more speakers 1210 of the system 1000 that is connected to the user output interface 1120.

Finally, the network interface 1160 provides functionality for the computer 1020 to download data from and/or upload data to one or more data communication networks.

It will be appreciated that the architecture of the system 1000 illustrated in FIG. 2 and described above is merely exemplary and that other computer systems 1000 with different architectures (for example with fewer components than shown in FIG. 1 or with additional and/or alternative components than shown in FIG. 1) may be used in embodiments of the invention. As examples, the computer system 1000 could comprise one or more of: a personal computer; a server computer; a mobile telephone; a smartphone (or smart device); a tablet; a laptop; other mobile devices or consumer electronics devices; etc.

Figure 1B:
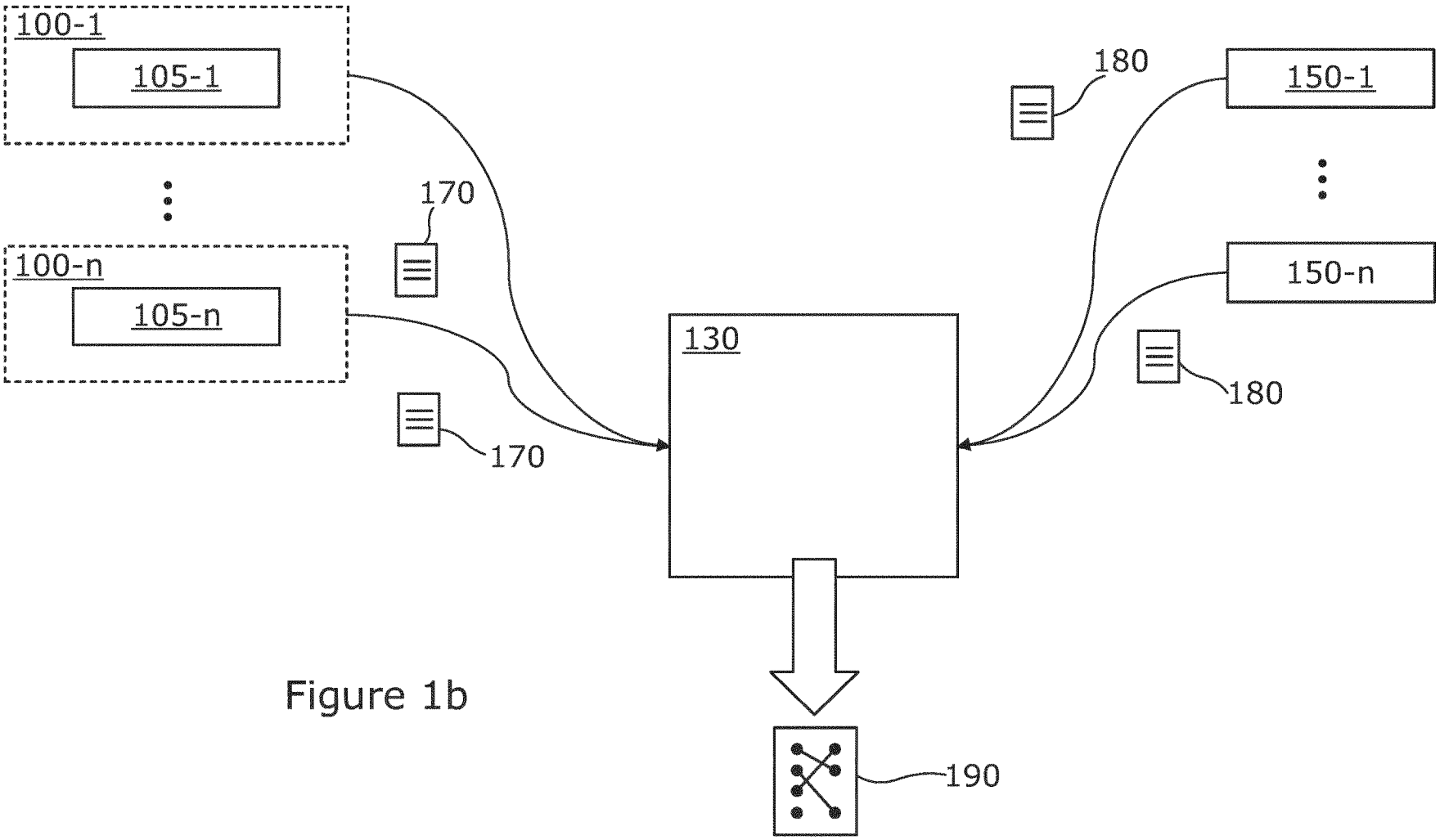
FIG. 1*b* schematically illustrates an analysis system that may be used in scenarios such as that depicted in FIG. 1*a;*
Figure 3:
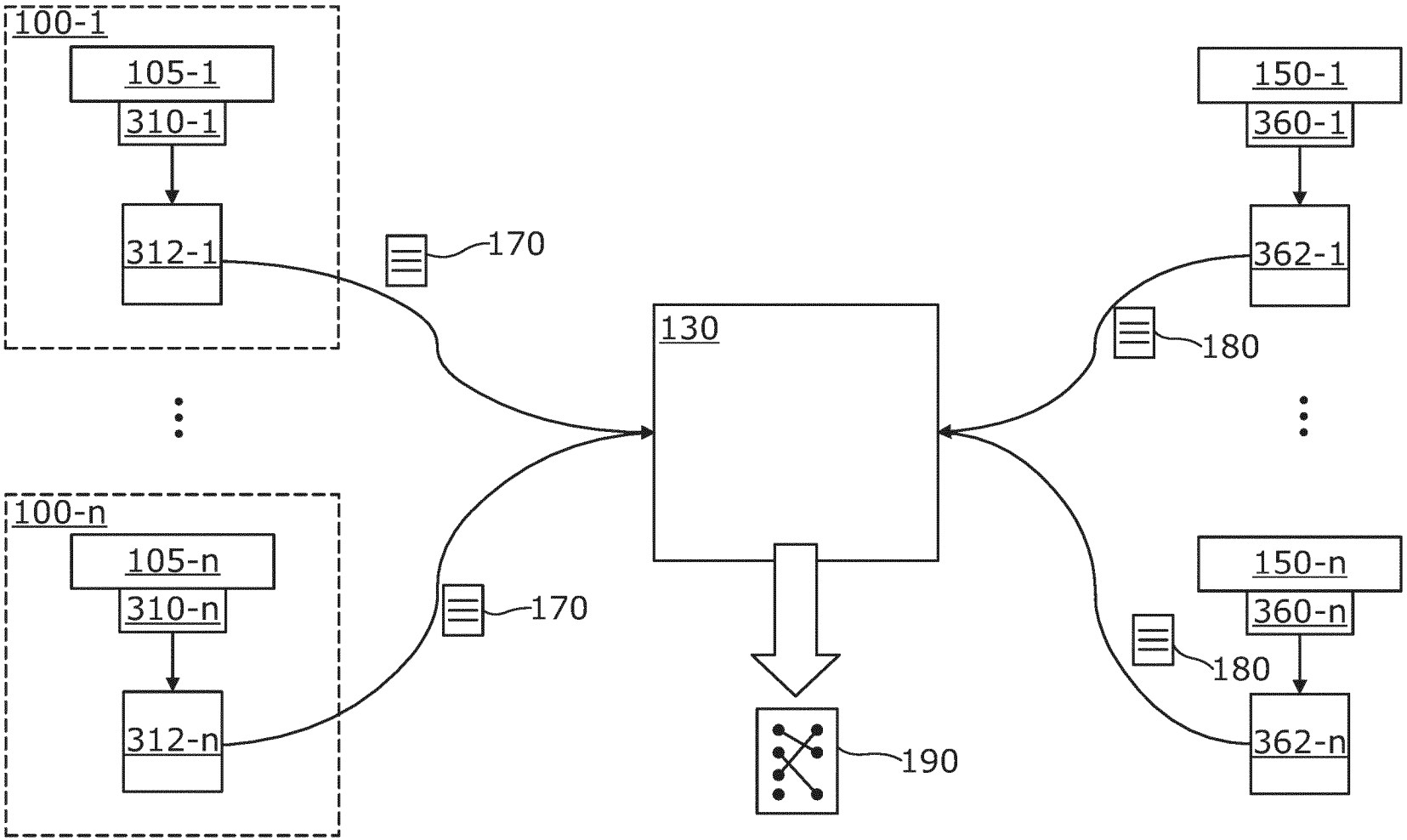
FIG. 3 illustrates a schematic diagram of a generalized system for putting the arrangement of FIG. 1*a* into effect.

A more detailed description of ways in which an arrangement such that illustrated in FIGS. 1*a*-1*c* may be put into effect, to enable the identification of firers (or attribution of projectile hits), is illustrated schematically in FIGS. 3 and 4, discussed below. As shown in FIG. 3 each participant 100-*n* has a ranged weapon 105-*n* (as previously described in relation to FIG. 1*a*).

A firing (or weapon) sensor arrangement 310-*n* is mounted on (or attached to or equipped to or otherwise provided with) the ranged weapon 105-*n*. The firing sensor arrangement 310-*n* is arranged to detect the discharge (or firing) of the ranged weapon 105-*n*. The sensor arrangement is typically arranged to detect the discharge of the ranged weapon based on characteristic movement (or motion) of the ranged weapon in response to the ranged weapon being fired (such as recoil). In this way the firing sensor arrangement 310-*n* may comprise any one or more of: a gyroscopic sensor; an accelerometer; a magnetometer; a tilt switch; and so on. Additionally, or alternatively the firing sensor arrangement 310-1 may be arranged to directly detect the firing of the ranged weapon, for example by directly detecting movement of a trigger and/or firing pin. However, it will be appreciated that a sensor arrangement 310-*n* that is arranged to detect the discharge of the ranged weapon based on characteristic movement may be preferred as these can be readily mounted and de-mounted from the ranged weapon (such as by accessory rails and the like).

The firing sensor arrangement 310-*n* may also be arranged to detect (or determine) one or more marksmanship scores for the discharge based on movement of the ranged weapon. In particular the firing sensor arrangement 310-1 may be arranged to determine any one or more of:

direction of the barrel movement during the discharge;
deviation from sighted position during the discharge;
Rate of movement of the barrel before and/or during and/or after the discharge.

Such marksmanship scores may be included by the firing sensor arrangement 310-1 in the projectile fire event.

The firing sensor arrangement 310-*n* may also be arranged to detect (or determine) one or more marksmanship faults (or errors). A marksmanship fault is a known weapon handling error (or issue) that may cause reduced firing accuracy. Examples of marksmanship faults may be any of:

Jerking the trigger;
Shouldering the rifle;
Pushing with the support hand;
Pulling with the firing hand;
Poor follow through;
Not enough trigger finger;
Support hand pulling;
Pushing with the firing hand.

Such marksmanship faults may be included by the firing sensor arrangement 310-1 in the projectile fire event.

An example of such a sensor arrangement 310-*n* is the MantisX device available from Mantis Tech, LLC of Oswego, Illinois, United States of America. As such firing sensors would be known to the skilled person we will not discuss their operation further herein.

As such it will be appreciated that the firing sensor arrangement 310-*n* may be arranged to weapon discharges as firing events. In general a firing event may be considered to be the detection of a solid projectile being fired (or launched) from a ranged weapon.

A weapon recording device 312-*n* is arranged to receive the projectile fire events from the firing sensor arrangement 310-*n*. Typically each operator 100-*n* has a respective weapon recording device 312-*n* connected to the weapon sensor arrangement 310-*n* of that operator's ranged weapon 105-*n*. It will be appreciated that an operator 105-1 may have more than one ranged weapon 105-1 (such as a sidearm and a rifle for example). The operator's ranged weapons 105-1 may share a recording device 312-*n*—i.e. the weapon recording device 312-*n* may be arranged to receive the projectile fire events from the firing sensor arrangements 110-*n* of two or more of the operator's ranged weapons 105-*n*. Alternatively each ranged weapon 105-1 of the operator may use a different weapon recording device 312-*n*—i.e. the weapon recording device 312-*n* may be arranged to receive the projectile fire events from the firing sensor arrangement 310-*n* of only one of the operator's ranged weapons 105-*n*.

It will be appreciated that the firing sensor arrangement 310-*n* are arranged to transmit (or send) the projectile fire events to the weapon recording device 312-*n* as they are detected. This may be thought of as transmitting the projectile fire events in real time (also known as streaming). The weapon recording device 312-*n* is arranged to timestamp each projectile fire event. The timestamp is applied to (or appended to or recorded with) the projectile fire event upon receipt. The weapon recording device 312-*n* is typically arranged to timestamp each projectile fire event using an internal time source (or clock) of the weapon recording device 312-*n*. Alternatively the weapon recording device 312-*n* is typically arranged to timestamp each projectile fire event using an external time source. For example, the weapon recording device 312-*n* may be arranged to timestamp each projectile fire event using a GPS time signal. Other examples of external time sources include radio time signals; network time signals (such as provided by a network time protocol) and the like.

The weapon recording device 312-*n* may be arranged to geostamp each projectile fire event. In particular, the weapon recording device 312-*n* is be arranged to record a geographical position (or location) with (or appended to, or as part of) each projectile fire event. Typically, such geographical position is obtained by the weapon recording device 312-*n* using a positioning system, such as GPS. However it will be appreciated that any suitable positioning system may be used including any global navigational satellite system such as any one or more of: GLONASS, Galileo, BeiDou, and so on. In this way it will be appreciated that the weapon recording device 312-*n* may record the location of the ranged weapon when the projectile was fired as part of the projectile fire event. Whilst the weapon recording device 312-*n* is typically arranged to geostamp each projectile fire event, it will be appreciated that the position of the participant may be tracked throughout the exercise by other means. As such the location of the participant at each point in time may be available from other sources, allowing the geostamps of projectile fire events to be reconstructed after the exercise before passing them to the analysis system discussed below.

The weapon recording device 312-*n* may be arranged to record further data (or information) with (or as part of) the projectile fire event. For example the weapon recording device 312-*n* may record any one or more of the following data with the projectile fire event:

the ranged weapon type;

the calibre of the projectile;

a participant identifier.

The weapon recording device 312-*n* is further arranged to provide (or transmit or send) the timestamped projectile fire events 170 to the analysis system 130. This may typically be achieved using a direct connection the analysis system 130 after the end of the live fire exercise. For example, by connecting each weapon recording device 312-*n* individually, or in groups, using cables to effect data transfer. However, it will be appreciated that the timestamped projectile fire events 170 may be provided to the analysis system 130 during the exercise, for example using appropriate mobile data (or radio) communication between the analysis system 130 and the weapon recording device 312-*n* such as a 3G (or 4G or LTE and the like) data connection. Equally, the weapon recording device 312-*n* may be connected to the analysis system 130 (or intermediate storage) using mobile data communication after the live fire exercise to provide the timestamped projectile fire events 170 to the analysis system 130.

The weapon recording device 312-*n* may be a computer system such as the computer system 100 described above. Preferably the weapon recording device is (or comprises or is embodied on) a smartphone or other mobile device. It will be appreciated that the use of a smartphone or mobile device may be preferable as such devices typically comprise a time source, mobile communication capabilities and positioning services and are often already carried by participants.

Whilst for ease of understanding the firing sensor arrangement 310-*n* and the weapon recording device 312-*n* are described above as separate devices it will be appreciated that they may be combined in a single device. Equally, some of the functionality, such as processing functionality, described as being carried out by the firing sensor arrangement 310-*n* may instead by offloaded (or carried out) by the weapon recording device 312-*n*. For example, in some examples the firing sensor arrangement 310-*n* may provide a raw (or unprocessed) stream of sensor reading the weapon recording device 312-*n*. Here the weapon recording device 312-*n* may then identify firing events from this stream of sensor readings. In the case of the MantisX device discussed above the firing sensor arrangement 310-*n* provides sensor readings to a paired smartphone (typically over a Bluetooth connection). An appropriate application (or app) on the smartphone then identifies the fire events. In this case the smartphone may also be used as the weapon recording device 312-*n* with a separate application running on the smartphone receiving the projectile fire events and processing them as discussed above.

As discussed in relation to FIG. 1*a* each target 150-*n* comprises (or has mounted or attached or equipped or otherwise provided with) a target sensor arrangement 360-*n*. The target sensor arrangement 360-*n* arranged to detect a projectile hit on (or arrival at) the target 150-*n*. Such target sensor arrangements 360-*n* may comprise any of:

one or more tilt switches which may detect when a target is hit (or knocked down) by the activation of the switch;

one or more accelerometers (such as gyro sensors) which may detect movement of the target indicating a hit;

one or more pressure sensors.

Additionally, or alternatively the target sensor arrangement 360-*n* may comprise one or more acoustic sensors. Acoustic sensors may detect a target hit based on the sound wave generated by the projectile (which in the case of firearms are typically supersonic). Some examples of target sensor arrangements 360-*n* are able to identify the position of the projectile as it passes through or past the target 150-*n*. In particular, such target sensor arrangements 360-*n* may be able to detect hits and misses where the miss was a within a certain distance of the target. Typically misses immediately around the target are detected as miss events. The area in which miss events are detected is commonly referred to in the art as the "near miss" area. Examples of such target sensor arrangements 360-*n* include the well-known Location Of Miss And Hit (LOMAH) bars, such as those available from Polytronic International AG of Muri AG, Switzerland. LOMAH bars (or sensor arrangements) typically use a plurality or array of acoustic sensors to determine the position in the X-Y plane of the target 150-*n* that the projectile travels through. As such target sensors would be known to the skilled person we will not discuss their operation further herein.

As such it will be appreciated that the target sensor arrangement 360-*n* may be arranged to detect hits and/or misses as hit events and miss events respectively. In general hit and miss events may both be thought of as projectile transit (or arrival) events. In particular a projectile transit event may be considered to be the detection of a solid projectile transiting (or arriving at the location of) the target.

The target sensor arrangement 360-*n* may be arranged to include (or store) additional data, detected by the target sensor arrangement 360-*n*, as part of the projectile transit event. In particular, the projectile transit event may also comprise any one or more of:

an aspect (or angle of incidence) of the projectile with the target 150-*n;* a position in the plane of the target 150-*n* that the projectile transited (or passed through);

the calibre of the projectile that transited the target;

a velocity of the projectile.

A target recording device 362-*n* is arranged to receive the projectile transit events from one or more target sensor arrangements 360-*n*. In some cases each target sensor arrangement 360-*n* may send the projectile transit events it detects (or generates) to a respective target recording device 362-*n*. Additionally, or alternatively two or more (or all) target sensor arrangements 360-*n* may send the projectile transit events they detect to a common target recording device 362-*n*. It will be appreciated that the target sensor arrangements 360-*n* are arranged to transmit (or send) the projectile transit events to the target recording device 362-*n* as they are detected. This may be thought of as transmitting the projectile transit events in real time (also known as streaming). The target recording device 362-*n* is arranged to timestamp each projectile transit event. The timestamp is applied to (or appended to or recorded with) the projectile transit event upon receipt.

The target recording device 362-*n* may be arranged to geostamp each projectile transit event. In particular, the target recording device 362-*n* may be arranged to record a geographical position (or location) of the respective target 150-*n* with (or appended to, or as part of) each projectile transit event. Typically, such geographical position is known for each target 150-*n* based on where the target was placed at the start of the live fire event. However it will be appreciated that a positioning system, such as GPS (or any suitable position system as discussed above) may be used to determine the target position. This is particularly the case for mobile targets 150-*n* whose position may change during the live fire event. In this way it will be appreciated that target recording device 162-*n* may record the location of the target 150-*n* when the projectile arrives at the target 150-*n* as part of the projectile transit event.

The target recording device 362-*n* is further arranged to provide (or transmit or send) the timestamped projectile transit events to the analysis system 130. This may typically be achieved using a direct connection the analysis system 130 after the end of the live fire exercise. For example, by connecting each target recording device 362-*n* individually, or in groups, using cables to effect data transfer. However, it will be appreciated that the timestamped projectile transit events 180 to the analysis system 130 during the exercise, for example using appropriate mobile data communication between the analysis system 130 and the target recording device 362-*n* such as a 3G (or 4G or LTE and the like) data connection. Equally, the target recording device 162-*n* may be connected to the analysis system 130 (or intermediate storage) using cables during the live fire exercise.

The target recording device 362-*n* may be a computer system such as the computer system 1000 described above.

Figure 4:
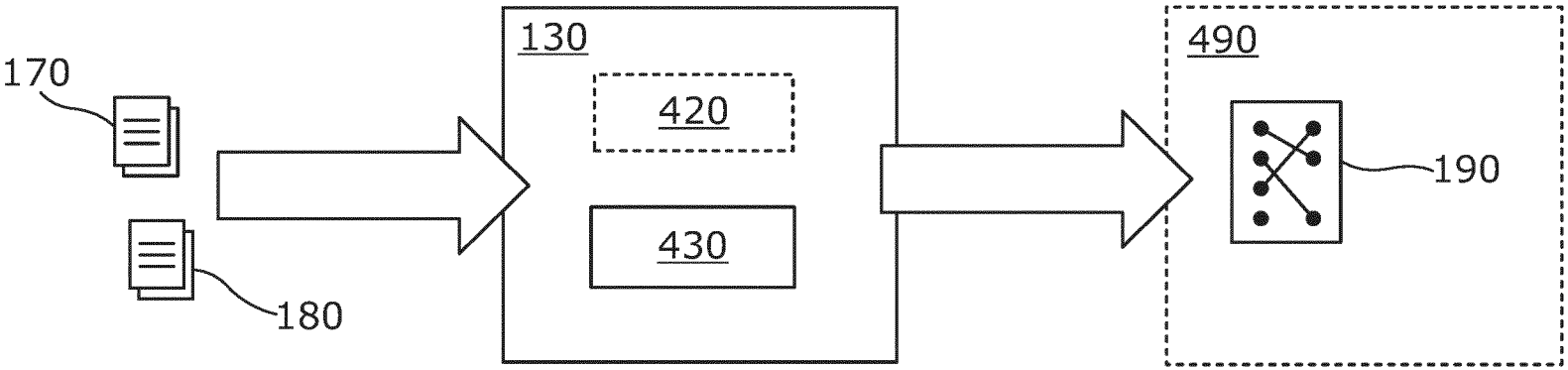
FIG. 4 illustrates a schematic diagram of a generalized system for putting the arrangement of FIG. 1*b* into effect.

As shown in FIG. 4 the analysis system comprises a matching module 430, and an optional timestamp synchronization module 420.

As described previously, in some cases the time sources used by the various recording devices when timestamping the projectile fire and projectile transit events may be well-synchronized allowing the timestamps from different time sources to be directly compared. However, it will be appreciated that for some recording devices (such as smartphones) the internal time source may not be synchronized and/or may drift over the course of the live fire exercise. In such cases the timestamp synchronization module may be present.

The timestamp synchronization module is arranged to synchronize the plurality of timestamped fire events and the plurality of timestamped transit events to a common time line (or reference). The timestamp synchronization module is typically arranged to determine a time offset for each recording device based on a discrepancy between the time source of the recording device and a common time source (such as an internal clock of the analysis system 130). The time offset for a recording device may be a constant time offset. Alternatively the time offset for a recording device may be time dependent. In this way it will be appreciated that drift of a time source of a recording device may be taken into account.

The timestamp synchronization module is arranged to apply the time offset for a recording device to the timestamps of each event received from (or recorded by) said recording device. In this way the timestamps generated by different non-synchronized recording devices may be directly compared.

In order to determine the time offset for a recording device the timestamp synchronization module may be arranged to receive a message from the recording device, timestamped by the recording device. The timestamp synchronization module may determine the time offset based on the difference between the internal clock of the recording device and the timestamp of the message. Typically, such a message based synchronization would be carried out before and/or after a live fire event. This would be time where direct connection (either physical or wireless) between the recording device and the timestamp synchronization module could be achieved.

It will be appreciated that by receiving two or more such timestamped messages from a recording device separated in time (such as before and after the live fire event) a time dependent offset may be calculated. As set out above such an offset may take account of drift. The timestamp synchronization module may therefore be arranged to receive one or more further timestamped message from the recording device, and determine a time dependent time offset based on the received messages.

The matching module 430 is arranged to identify for each of at least some of the plurality of projectile transit events the respective projectile fire event corresponding to the firing of the projectile that arrived at the respective target, by comparing the timestamps of the projectile transit events and the projectile fire events, and the relative positions of the projectile fire events with the respective targets of the projectile transit events. Where the events are not synchronized (for example by way of the prior synchronization of the recording devices as described above) the matching module 430 is arranged to operate on the synchronized events generated by the time synchronization module.

The matching module 430 is typically arranged to identify the most likely set of matches (or correspondence) between the projectile transit events and the projectile fire events. In particular, the matching module 430 may generate a plurality of possible matches based on at least the timestamps of the respective projectile transit events and projectile fire events. The matching module 430 may then select a set of matches that minimizes a measure of discrepancy between the matched projectile transit events and the respective projectile fire events based on the timestamps of the projectile transit events and the projectile fire events, and the relative positions of the projectile fire events with the respective targets of the projectile transit events.

As set out in more detail below the matching module 430 may be arranged to identify the set of matches by optimizing a weighted bipartite graph representing potential matches between the projectile transit events and the projectile fire events.

Also shown in FIG. 4 is a further processing module which may be arranged to attribute projectile transit events to the operator that fired the shot based on the identified matches 190. In this way the further processing module 490 may be further arranged to analysed and/or display transit events (such as hits and/or misses) on a per participant basis.

Figure 5:
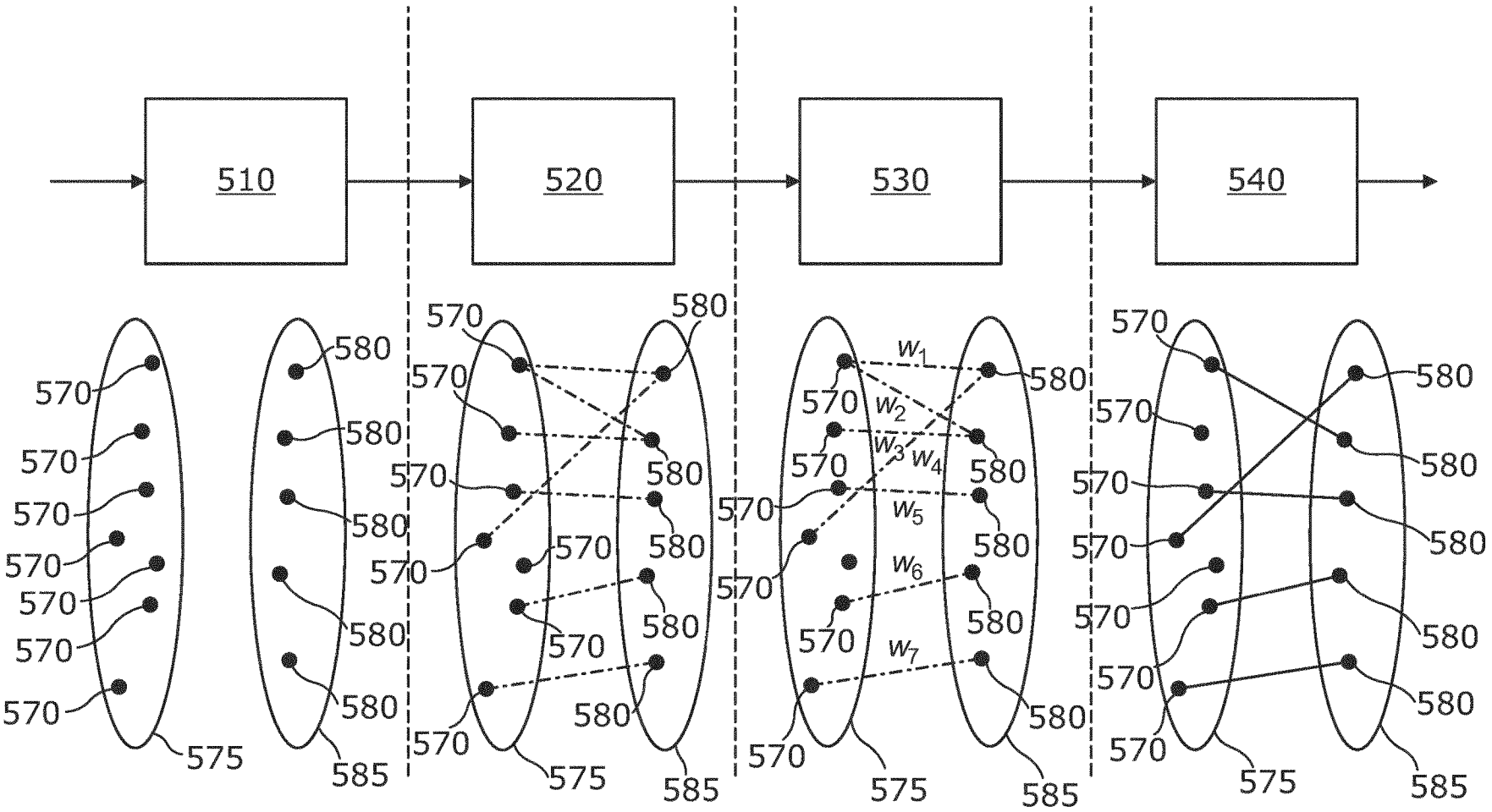
FIG. 5 schematically illustrates an example method of identifying matches which may be carried out by the system shown in FIG. 4.

The further processing module 490 may be arranged to generate one or more marksmanship metrics for a participant based on the identified matches 190. The marksmanship metrics may comprise any one or more of:

- Shot (or firing) accuracy;
- Maximum and/or minimum range of shots on target;
- Shot grouping or patterns;
- Miss grouping or patterns;
- Mean point of impact (MPI);
- Extreme spread;
- Rate of fire
- Suppressive effect (suppression being typically defined as one round within one metre of the target every six seconds).
- Reaction time
- Ammunition consumption rate FIG. 5 schematically illustrates an example method of identifying matches which may be carried out by the matching module 430. FIG. 5 also illustrates a bipartite graph representing the operation of the method at each step.

At a step 510 the matching module 430 represents each projectile fire event as a node 570 in a first set of nodes 575, and each projectile transit events as a node of a second type. In this way it will be appreciated that the two sets of nodes correspond to the two sets of nodes (or vertices) that are comprised in a bipartite graph (commonly known as the parts of a bipartite graph).

At the step 520 the matching module 430 generates one or more initial edges (or connections), indicated in FIG. 5 by the dashed-dotted lines. Each initial edge links (or connects) a respective projectile fire event (a node in the first set of nodes) with a respective projectile transit event (a node in the second set of nodes). An initial edge corresponds to an edge of a bipartite graph and represents (or indicates) a potential match between the projectile fired in the projectile fire event and the projectile that arrived at the target in the projectile transit event. The matching module 430 generates the one or more initial edges based on one or more initial criteria applied to the timestamps and/or geostamps of the projectile firing events and the projectile transit events. In particular, the matching module 430 is arranged to generate all edges that satisfy the criteria as initial edges. For example, the criteria typically comprise a causal criterion. An example of a causal criterion is that the matching module will not generate and edge between (or linking) a projectile fire event and a projectile transit event if the timestamp of the projectile fire event is after (or later in time) the timestamp of the projectile transit event. This is because that such a match would clearly violate causality as the shot could not have been fired after the projectile reached the target.

Similarly, the criteria may comprise a maximum range criterion. An example of a maximum range criterion is that the matching module will only generate an event if the timestamp of the projectile fire event is within a pre-determined time threshold of the timestamp of the projectile transit event. The pre-determined time threshold may be determined based on maximum projectile flight duration. For example, as the maximum range of a shot, $d_{max}$, and a minimum shot velocity, $v_{min}$, may be estimated, a maximum shot time (or projectile flight duration) may be calculated as $t_{max}=d_{max}/v_{min}$. Such a time threshold may also take into account the expected accuracy of the timestamps. It will be appreciated that a constant time threshold may be used for all events. For example a time threshold based on the maximum shot time for all weapons in the life fire exercise. Alternatively, different maximum shot times may be used for different ranged weapons. In this case the maximum shot time may be selected based on the ranged weapon and/or calibre specified in the projectile fire event.

At a step 530 the matching module 430 assigns a respective weight $w_1$; $w_2$; . . . ; $w_7$ to each edge (or connection). In the discussion below we will refer to a general weight for the $n^{th}$ edge as $w_n$. The weight $w_n$ for an edge is based on the timestamps and relative positions of the projectile transit event of the edge and the projectile fire event of the edge. Typically, the weight $w_n$ comprises a discrepancy (or difference) between the timestamp of the projectile transit event and an expected time based on the timestamp of the projectile fire event and the relative positions (or distance between) of the projectile fire event and the projectile transit event. In other words the weight typically comprises a difference between the actual arrival (or transit) time of the projectile and the expected (or predicted or projected) arrival (or transit time) of the projectile had the projectile originated from the projectile fire event. Here the actual arrival time is the time recorded by the target with appropriate synchronisation if needed. This may be thought of as a measure of discrepancy between the projectile fire event and the projectile transit event.

For example the weight may comprise the term $t_f-t_t+dv$, where $t_f$ is the time (or timestamp) of the projectile fire event, $t_t$ is the time (or timestamp) of the projectile transit event, d is the distance between the projectile fire event and the projectile transit event (which may be calculated using geostamps of both events, and/or a known position of the respective target), and v is the velocity of the projectile from the projectile fire event. As set out above, v may be assumed to be a constant value (such as an average value) for all of the projectile fire events or may be dependent on the weapon type and/or calibre specified in the projectile fire event. Alternatively, v may be taken to be the arrival velocity of the projectile, as measured by the target sensor arrangement 360-*n* discussed above. It will be appreciated that it is typically the magnitude of the above term that forms part of the weight as the difference may be positive or negative.

It will also be appreciated that further measures of discrepancy may be included in the weight $w_n$ for an edge. For example the weight for an edge may include terms based on one or more of the following:

- a difference between the calibre in the projectile fire event and the calibre in the projectile transit event;
- a difference (or discrepancy) between the aspect (or angle on incidence) of the projectile transit event and the weapon direction in the projectile fire event;
- a difference between the recorded arrival velocity at the target and a predicted velocity. It will be appreciated that a predicted arrival velocity may be calculated from a known velocity profile for the ranged weapon and the distance between the target and the participant.

As such it will be appreciated that step 530 may be said to form a weighted bipartite graph of the projectile fire events and the projectile transit events, where the weights indicate (or are based on or otherwise define) a measure of discrepancy between the projectile fire event and the projectile transit event.

It will also be appreciated that in an alternative formulation some of the initial criteria may be omitted from step 510 may instead be additional terms in the weights for each initial edge. For example, the maximum range criterion may take the form of a logistic function centred on the maximum shot time, again with a high (or near infinite) weight being generated if the actual shot time corresponding to the edge exceeds the maximum shot time. Similar, some of the additional weight terms set out above in step 530 may instead be used as initial criteria. For example discrepancy in calibre may instead be an initial criteria such that an initial edge is not generated if the difference in calibre exceeds a pre-determined threshold. These selections may be made by the skilled person based on the accuracy of the measures and the range of values expected in the exercise. It will be understood that these formulations are simply used as examples of the functions that the skilled person may select based on the criteria desired.

At a step 540 the matching module 430 optimizes the set of initial edges to form a set of final edges based on the edge weights. The set of final edges represent the identified correspondence between the plurality of projectile transit events and the plurality of projectile fire events. In this way the step 540 may be thought of as identifying for one or more of the projectile transit events which projectile fire event corresponded to the firing of the projectile that arrived at the respective target.

Typically the step 540 comprises identifying a sub set of edges that maximise the number of matches with the minimum total edge weight. Here it will be appreciated that the sub set of edges is required not to have any edges that start or end on the same node as another edge in the sub set. In this way it will be appreciated that step 540 may be thought of as finding the minimum weight full matching solution to the weighted bipartite graph generated in step 530.

FIG. 6*a* shows example projectile fire events such as those that may be generated by the methods and systems of the invention described above.

Each row in FIG. 6*a* corresponds to a projectile fire event. As can be seen the projectile hit event comprises: an identification of the weapon recording device 312-*n* (labelled device_id), a timestamp (labelled time), this information is also presented as a time elapsed measure in milliseconds (labelled shot_time_ms); a geostamp in latitude and longitude (labelled lat and long); a marksmanship score for the shot (labelled score) and a marksmanship fault for the shot (labelled fault).

The projectile hit events were generated using the MantisX system as discussed previously which generated the marksmanship scores and marksmanship faults. The geostamps and time stamps and device identifiers were generated using the weapon recording devices which in this case were smartphones carried by the participants.

FIGS. 6*b* and 6*c* show example projectile transit events such as those that may be generated by the methods and systems of the invention described above.

In FIG. 6*b* the projectile transit events are stored as XML. Each projectile transit event is within a "Shot" tag and comprises: an indication of whether the event is a hit or a miss (in the "Accur" tag); the x and y co-ordinates in the plane of the target that the projection passed through (in the "X" and "Y" tags); the angle of incidence (here measured in tenths of a degree) of the projectile to the target (in the "Azi" tag); an identifier for the target (in the "TargetID" tag); and the timestamp (in the "DT" tag).

The projectile transit events were generated by a LOMAH bar attached to a standard target and the timestamp was generated by respective recording devices coupled to the LOMAH bars. In this case a Saab LOMAH bar forms the target sensor arrangement.

In FIG. 6*c* each row corresponds to a projectile transit event. Here, each projectile transit event comprises: the x and y co-ordinates in the plane of the target that the projection passed through (in the "Xcoord" and "Ycoord" columns), along with respective error estimates (labelled "Xerror" and "Yerror"); the calibre of the projectile (in the "Caliber" column); the angle of incidence (here measured in tenths of a degree) of the projectile to the target (in the "Azimuth" column); the arrival velocity of the projectile (in the "Velocity" column); the timestamp (in the "local_time" column); and an identifier for the target (in the "target" column).

Figure 7:
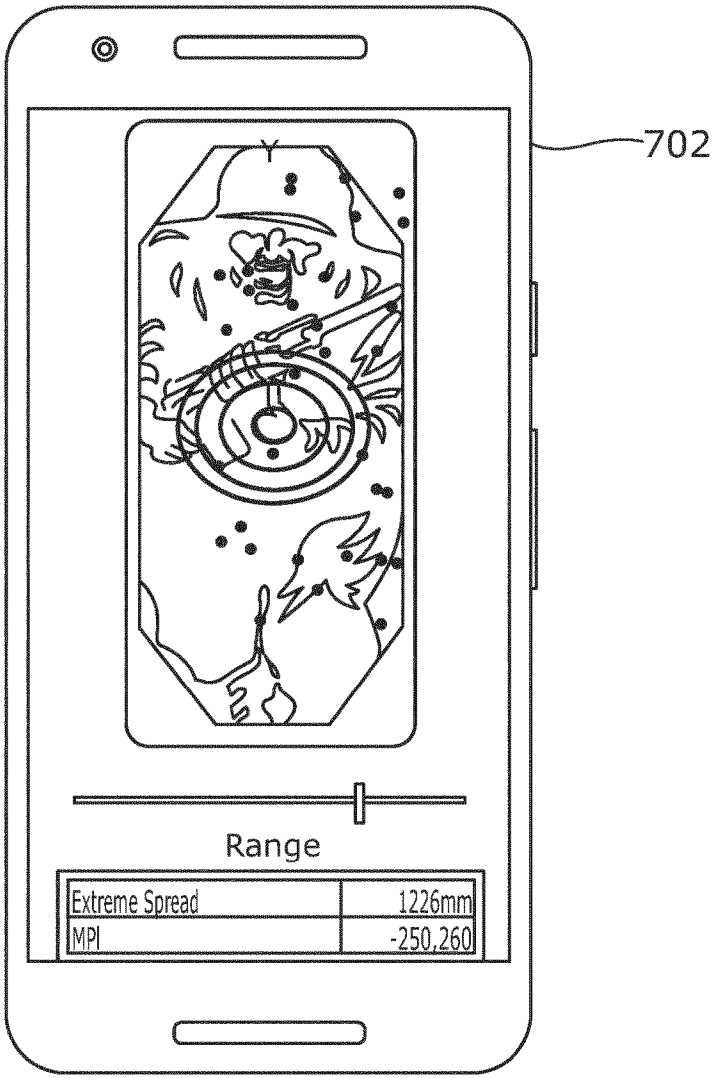
FIG. 7 shows example marksmanship metrics generated by methods and systems of the invention as displayed to a participant.
Figure 7:
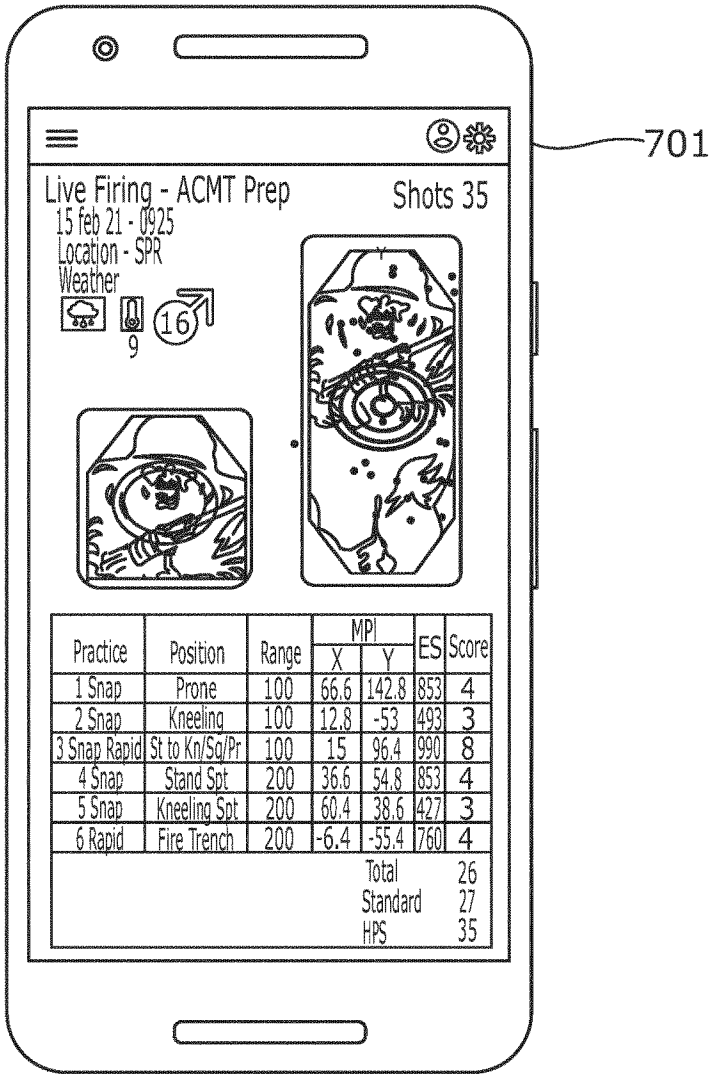

FIG. 7 shows example marksmanship metrics generated by methods and systems of the invention as displayed to a participant. FIG. 7 shows two marksmanship metric screens 701; 702 shown to a participant.

In the first screen 701 the participant is shown the projectile transit events for a given target, attributed to them, as dots on an image of the target. As can be seen these projectile transit events include hits, which are the dots within the trapezoidal area, and misses which fall outside of the trapezoidal area or pass through the target area when the target was not up. These particular events are attributed to particular time period in the exercise, namely the "4 Snap" exercise. Also shown is the x and y coordinates for the "mean point of impact" for the transit events attributed to the participant.

In the second screen 702 the participant is again shown the projectile transit events for a given target, attributed to them, as dots on an image of the target. Here another mean point of impact for these transit events is shown along with a measure of the spread, here the distance between the two furthest apart transit events.

Figure 8:
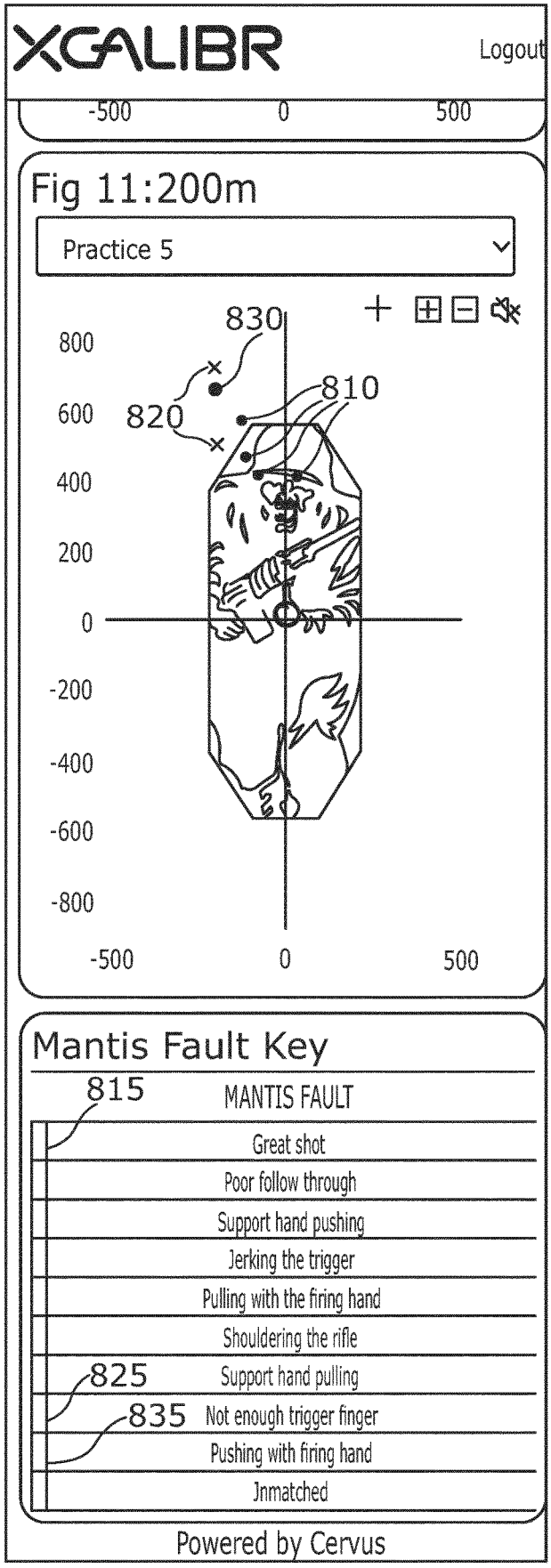
FIG. 8 shows example marksmanship faults generated by methods and systems of the invention as displayed to a participant.

FIG. 8 shows example marksmanship faults generated by methods and systems of the invention as displayed to a participant. FIG. 8 shows a marksmanship fault screen displayed to a participant.

As can be seen in FIG. 8 the participant is shown their own target hits and misses for a particular target. These hits and misses are superimposed over an image of the target, as dots, based on the target x and y coordinates recorded with each projectile transit event. As these projectile transit events have been matched with the participants own projectile fire events any marksmanship faults associated with the fire events may be displayed with the hit/miss event. In this case the hit/miss events are shown as coloured dots with a colour corresponding to the identified marksmanship faults shown in the key. Like reference numerals for like colours have been included for ease of reproduction.

Here the green dots 810 correspond to projectile fire and transit events with no marksmanship faults detected—labelled with the "Great shot" legend 815. The magenta dots 820 correspond to projectile fire and transit events with a "Not enough trigger finger" fault detected—labelled with the "Not enough trigger finger" legend 825. The cyan dot 830 corresponds to projectile fire and transit events with a "Pushing with firing hand" fault detected-labelled with the "Pushing with firing hand" legend 835.

This provides the participant with clear feedback as to the effect of different marksmanship faults.

Figure 9:
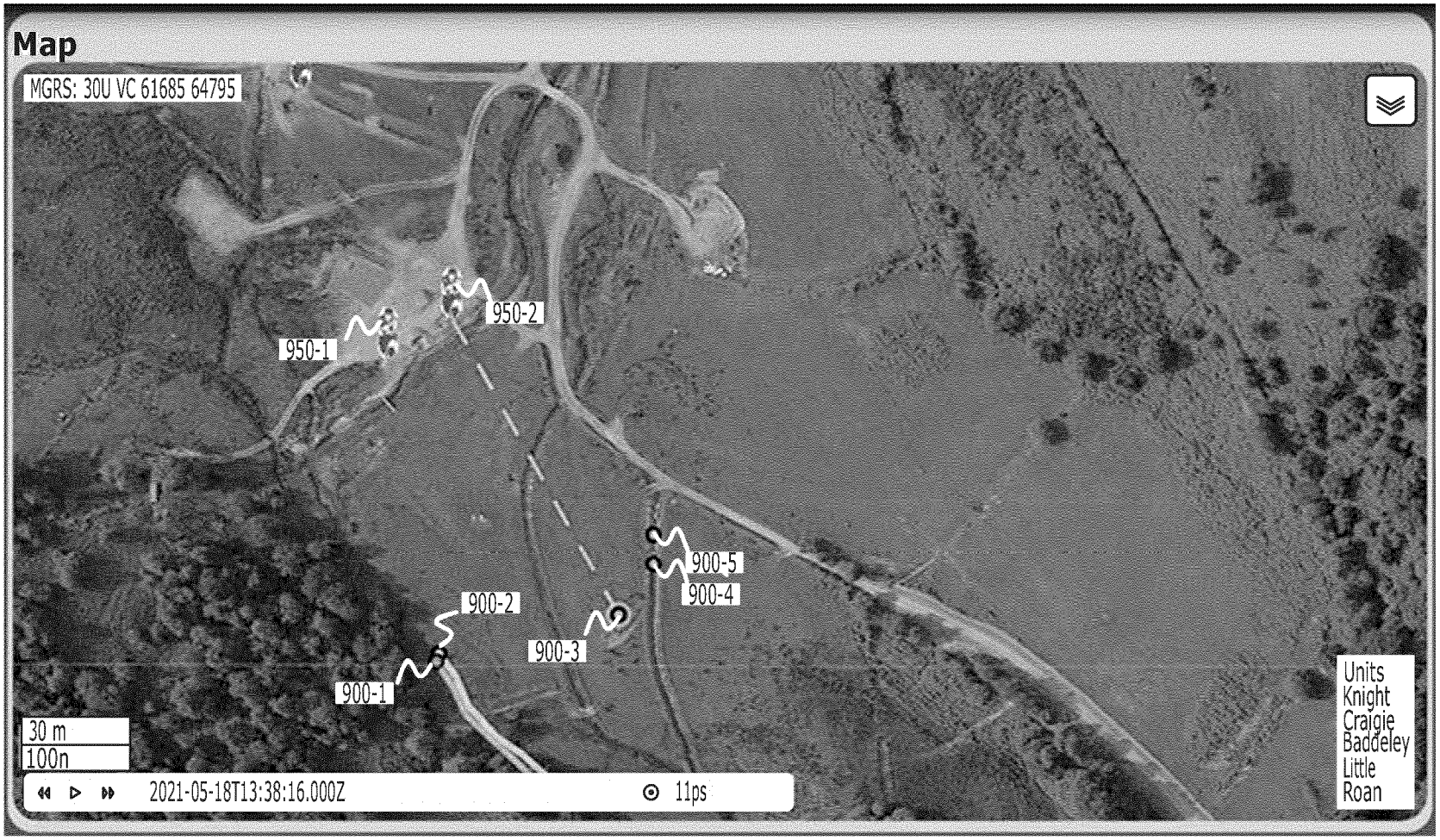
FIG. 9 shows an example plot of a live fire exercise situation at a particular point in time, such as the situation in FIG. 1*a*, showing a match as determined by the methods and systems of the invention.

FIG. 9 shows an example plot of a live fire exercise situation at a particular point in time, such as the situation in FIG. 1*a*, showing a match as determined by the methods and systems of the invention.

As shown in FIG. 9 there are five participants 900-1; 900-2; 900-3; 900-4; 900-5 and two targets 950-1; 950-2. The positions of the participants 900-1; 900-2; 900-3; 900-4; 900-5 and of the targets 950-1; 950-2 are plotted on an overhead image of the terrain of the exercise. The positions of the targets 950-1; 950-2 are known as they are static, and the positions of the participants 900-1; 900-2; 900-3; 900-4; 900-5 is known through GPS tracking (and the geotagging present in any projectile fire events they generate). As shown by the dashed line plotted in FIG. 9 the methods describe above have identified a match between a fire event generated by the third participant 900-3 and a hit event detected at the second target 950-2, thereby determining that the third participant fired a projectile that hit the second target 950-2 at the current time. It will be appreciated that further images at further points in time may be plotted in a similar way indicting matched pairs of events. In this way a time series of images or video may be generated showing the progression of the olive fire exercise and indicating the shots taken as determined by the methods of the invention described previously.

It will be appreciated that the methods described have been shown as individual steps carried out in a specific order. However, the skilled person will appreciate that these steps may be combined or carried out in a different order whilst still achieving the desired result.

It will be appreciated that embodiments of the invention may be implemented using a variety of different information processing systems. In particular, although the figures and the discussion thereof provide an exemplary computing system and methods, these are presented merely to provide a useful reference in discussing various aspects of the invention. Embodiments of the invention may be carried out on any suitable data processing device, such as a personal computer, laptop, personal digital assistant, mobile telephone, set top box, television, server computer, etc. Of course, the description of the systems and methods has been simplified for purposes of discussion, and they are just one of many different types of system and method that may be used for embodiments of the invention. It will be appreciated that the boundaries between logic blocks are merely illustrative and that alternative embodiments may merge logic blocks or elements, or may impose an alternate decomposition of functionality upon various logic blocks or elements.

It will be appreciated that the above-mentioned functionality may be implemented as one or more corresponding modules as hardware and/or software. For example, the above-mentioned functionality may be implemented as one or more software components for execution by a processor of the system. Alternatively, the above-mentioned functionality may be implemented as hardware, such as on one or more field-programmable-gate-arrays (FPGAs), and/or one or more application-specific-integrated-circuits (ASICs), and/or one or more digital-signal-processors (DSPs), and/or other hardware arrangements. Method steps implemented in flowcharts contained herein, or as described above, may each be implemented by corresponding respective modules; multiple method steps implemented in flowcharts contained herein, or as described above, may be implemented together by a single module.

It will be appreciated that, insofar as embodiments of the invention are implemented by a computer program, then a storage medium and a transmission medium carrying the computer program form aspects of the invention. The computer program may have one or more program instructions, or program code, which, when executed by a computer carries out an embodiment of the invention. The term "program" as used herein, may be a sequence of instructions designed for execution on a computer system, and may include a subroutine, a function, a procedure, a module, an object method, an object implementation, an executable application, an applet, a servlet, source code, object code, a shared library, a dynamic linked library, and/or other sequences of instructions designed for execution on a computer system. The storage medium may be a magnetic disc (such as a hard drive or a floppy disc), an optical disc (such as a CD-ROM, a DVD-ROM or a BluRay disc), or a memory (such as a ROM, a RAM, EEPROM, EPROM, Flash memory or a portable/removable memory device), etc. The transmission medium may be a communications signal, a data broadcast, a communications link between two or more computers, etc.

The invention claimed is:

1. A method of capturing a marksmanship data during a live fire exercise wherein a plurality of participants fire projectiles at one or more targets using ranged weapons, said method comprising:

recording, by a computerized weapon recording device, a plurality of timestamped projectile fire events detected by respective firing sensors at respective ranged weapons and each corresponding to the respective ranged weapon discharging a projectile, each timestamped projectile fire event recorded at a recording device of the operator of the respective ranged weapon and comprising a position of the ranged weapon;

recording, by a computerized target recording device, a plurality of timestamped projectile transit events detected at respective targets by respective target sensors and each corresponding to the arrival of a projectile at the respective target, each timestamped projectile transit event recorded at a recording device of the respective target;

identifying, by a computerized processing module, for each of at least some of the plurality of projectile transit events the respective projectile fire event corresponding to the firing of the projectile that arrived at the respective target, based at least in part on comparing the timestamps of the projectile transit events and the projectile fire events, said identifying further comprising optimizing a bipartite graph representing the plurality of fire events and the plurality of transit events, said bipartite graph comprising one or more edges linking a respective projectile fire event to a respective transit event; and providing a report identifying one or more projectile transit events of the plurality of projectile transit events and indicating one or more fire events of the plurality of fire events that resulted in the one or more projectile transit events.

2. The method of claim 1, wherein the respective timestamp of each projectile fire event and each projectile transit event is generated based on an internal clock of the respective recording device.

3. The method of claim 2, further comprising synchronising the plurality of timestamped fire events and the plurality of timestamped transit events to a common time line.

4. The method of claim 3, wherein said synchronising comprises applying a respective time offset to one or more events based on a time offset between the internal clock of the respective recording device and a common time source.

5. The method of claim 2, wherein said synchronising comprises synchronising the internal clocks of one or more recording devices to a common time source prior to the live fire exercise.

6. The method of claim 1, wherein the respective timestamp of each projectile fire event and each projectile transit event is generated based on an external clock.

7. The method of claim 1, wherein each edge is weighted according to a difference between the timestamp of the respective hit event and the timestamp of the respective transit event.

8. The method of claim 7, wherein each edge is weighted according to a difference between a projected target transit time corresponding to the respective projectile fire event and the respective projectile transit event and the timestamp of the respective transit event.

9. The method of claim 8, wherein the projected target transit time is based on the distance between the geographical coordinates of the respective ranged weapon and the geographical coordinates of the target, and the timestamp of the respective projectile fire event.

10. The method of claim 1, wherein the recording devices for the projectile fire events are smartphones.

11. The method of any claim 1, wherein detecting the projectile transit events comprises detecting a calibre of the respective projectile, and the detected calibre is recorded with the projectile transit event.

12. The method of claim 1, wherein detecting the one or more projectile arrival events comprises detecting whether the respective projectile hit or missed the respective target, and the detected hit or miss is recorded with the projectile arrival event.

13. The method of claim 1, further comprising attributing one or more projectile transit events to the participant corresponding to the matching projectile fire events.

14. The method of claim 13 further comprising displaying the projectile transit events for said participant.

15. The method of claim 13 further comprising generating one or more marksmanship metrics for the participant based on the projectile transit events attributed to said participant.

16. A method of a projectile fire analysis of a live fire exercise wherein a plurality of participants fire projectiles at one or more targets using ranged weapons, the method comprising:

receiving from respective recording devices of each of the plurality of participants, respective timestamped projectile fire events detected by respective firing sensors at respective ranged weapons and each corresponding to the operator discharging a projectile from a ranged weapon and comprising a position of the ranged weapon;

receiving from respective recording devices connected to each of the one or more targets, timestamped projectile transit events detected by respective target sensors at respective targets and each corresponding to the arrival of a projectile at the respective target;

identifying, by a computerized processing module, for each of at least some of the plurality of projectile transit events the respective projectile fire event corresponding to the firing of the projectile that arrived at the respective target, based at least in part on comparing the timestamps of the projectile transit events and the projectile fire events, said identifying further comprising optimizing a bipartite graph representing the plurality of fire events and the plurality of transit events, said bipartite graph comprising one or more edges linking a respective projectile fire event to a respective transit event; and providing a report identifying one or more projectile transit events of the plurality of projectile transit events and indicating one or more fire events of the plurality of fire events that resulted in the one or more projectile transit events.

17. An apparatus for projectile fire analysis of a live fire exercise wherein a plurality of participants fire projectiles at one or more targets using ranged weapons, the apparatus comprising a processor and a memory, the memory storing instructions which when executed by the processor cause the processor to carry out the steps of:

receiving from respective recording devices of each of the plurality of participants, respective timestamped projectile fire events detected by respective firing sensors at respective ranged weapons and each corresponding to the operator discharging a projectile from a ranged weapon and comprising a position of the ranged weapon;

receiving from respective recording devices connected to each of the one or more targets, timestamped projectile transit events detected by respective target sensors at respective targets and each corresponding to the arrival of a projectile at the respective target;

identifying, by a computerized processing module, for each of at least some of the plurality of projectile transit events the respective projectile fire event corresponding to the firing of the projectile that arrived at the respective target, based at least in part on comparing the timestamps of the projectile transit events and the projectile fire events, said identifying further comprising optimizing a bipartite graph representing the plurality of fire events and the plurality of transit events, said bipartite graph comprising one or more edges linking a respective projectile fire event to a respective transit event; and providing a report identifying one or more projectile transit events of the plurality of projectile transit events and indicating one or more fire events of the plurality of fire events that resulted in the one or more projectile transit events.

* * * * *